US008696054B2

(12) United States Patent
Crum

(10) Patent No.: US 8,696,054 B2
(45) Date of Patent: Apr. 15, 2014

(54) ENHANCED COMPATIBILITY FOR A LINKAGE MECHANISM

(75) Inventor: Michael Crum, Mantachie, MS (US)

(73) Assignee: L & P Property Management Company, South Gate, CA (US)

( * ) Notice: Subject to any disclaimer, the term of this patent is extended or adjusted under 35 U.S.C. 154(b) by 80 days.

(21) Appl. No.: 13/295,223

(22) Filed: Nov. 14, 2011

(65) Prior Publication Data

US 2012/0299363 A1 Nov. 29, 2012

Related U.S. Application Data

(60) Provisional application No. 61/489,515, filed on May 24, 2011.

(51) Int. Cl.
*A47C 1/031* (2006.01)

(52) U.S. Cl.
USPC ..... 297/85 M; 297/83; 297/84

(58) Field of Classification Search
USPC ..... 297/84, 85 M, 85 R, 85 L, 89
See application file for complete search history.

(56) References Cited

U.S. PATENT DOCUMENTS 3,233,938 A * 2/1966 Fletcher ..... 297/84
3,622,198 A * 11/1971 Re ..... 297/94
3,747,973 A * 7/1973 Re ..... 297/84
3,958,827 A * 5/1976 Re ..... 297/61
4,195,878 A * 4/1980 Cycowicz et al. ..... 297/83
4,216,991 A * 8/1980 Holobaugh ..... 297/85 R
4,306,746 A * 12/1981 Crum ..... 297/85 R
4,418,957 A * 12/1983 Rogers, Jr. ..... 297/85 R
4,707,025 A * 11/1987 Rogers, Jr. ..... 297/259.2
4,740,031 A * 4/1988 Rogers, Jr. ..... 297/85 L
5,072,988 A * 12/1991 Plunk ..... 297/68
5,527,092 A 6/1996 Cook et al.
5,772,278 A * 6/1998 Kowalski ..... 297/85 L
5,975,627 A * 11/1999 LaPointe et al. ..... 297/68
5,992,930 A * 11/1999 LaPointe et al. ..... 297/68
6,729,686 B2 * 5/2004 May ..... 297/84
6,793,279 B2 * 9/2004 Hoffman et al. ..... 297/84

(Continued)

OTHER PUBLICATIONS

Notification of Transmittal of the International Search Report and the Written Opinion of the International Searching Authority, or the Declaration is PCT/US2012/039340, dated Aug. 7, 2012, 11 pages.

*Primary Examiner* — David R Dunn
*Assistant Examiner* — Alexander Harrison
(74) *Attorney, Agent, or Firm* — Shook Hardy & Bacon LLP

(57) ABSTRACT

Provided is a linkage mechanism for a recliner that includes a seat rail, an arm mounting plate that is vertically supported by one or more legs, a footrest assembly adapted to extend otto-man(s) when the recliner is adjusted from a closed to an extended position, and a roller link that translates forward when the recliner is adjusted from the extended position to a reclined position. The arm mounting plate includes a forward guide slot and a rearward guide slot having respective tracks installed thereto. The roller link includes a forward roller and a rearward roller that are rotatably coupled thereto. Further, the forward and rearward rollers are moveably engaged to the tracks of the forward and rearward guide slots, respectively, facilitating the forward translation of the roller link. A pair of substantially parallel-spaced TV links act in cooperation to pivotably couple the roller link to the arm mounting plate.

19 Claims, 8 Drawing Sheets

(56) References Cited

U.S. PATENT DOCUMENTS

| | | | | |
|---|---|---|---|---|
| 7,147,278 | B2 | 12/2006 | Johnson et al. | |
| 7,497,512 | B2 * | 3/2009 | White et al. | 297/85 R |
| 7,585,018 | B2 * | 9/2009 | LaPointe et al. | 297/85 L |
| 7,641,277 | B2 | 1/2010 | Lawson et al. | |
| 8,016,348 | B2 * | 9/2011 | Hoffman et al. | 297/85 M |
| 8,308,228 | B2 * | 11/2012 | Lawson et al. | 297/330 |
| 8,398,165 | B2 * | 3/2013 | Lawson | 297/85 M |
| 2002/0149238 | A1 * | 10/2002 | Hoffman et al. | 297/85 |
| 2003/0015893 | A1 * | 1/2003 | Hoffman et al. | 297/85 |
| 2003/0057743 | A1 * | 3/2003 | May | 297/84 |
| 2008/0001442 | A1 * | 1/2008 | Wiecek | 297/85 |
| 2008/0111402 | A1 * | 5/2008 | Crum | 297/85 |
| 2008/0150329 | A1 * | 6/2008 | Lawson | 297/84 |
| 2010/0127555 | A1 * | 5/2010 | Hoffman et al. | 297/85 M |
| 2010/0127556 | A1 * | 5/2010 | Hoffman et al. | 297/85 R |
| 2011/0018331 | A1 * | 1/2011 | Murphy et al. | 297/85 R |
| 2011/0175426 | A1 * | 7/2011 | Lawson | 297/85 M |
| 2011/0181094 | A1 * | 7/2011 | Lawson et al. | 297/85 R |
| 2011/0233972 | A1 * | 9/2011 | Weicek | 297/84 |
| 2012/0049606 | A1 * | 3/2012 | Lawson et al. | 297/85 M |
| 2012/0112518 | A1 * | 5/2012 | Murphy et al. | 297/85 L |
| 2012/0112519 | A1 * | 5/2012 | Murphy et al. | 297/85 M |
| 2012/0119547 | A1 * | 5/2012 | Hoffman et al. | 297/84 |
| 2012/0235449 | A1 * | 9/2012 | Wiecek | 297/84 |
| 2012/0286557 | A1 * | 11/2012 | Hoffman et al. | 297/85 M |

* cited by examiner

ENHANCED COMPATIBILITY FOR A LINKAGE MECHANISM

CROSS-REFERENCE TO RELATED APPLICATIONS

This application claims the benefit of U.S. Provisional Application No. 61/489,515, filed May 24, 2011, entitled "Enhanced Compatibility for a Linkage Mechanism," herein incorporated by reference.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit (e.g., high-leg chairs), which is otherwise limited by the configurations of linkage mechanisms in the field.

Reclining seating units exist that allow a user to forwardly extend a footrest and to recline a backrest rearward relative to a seat. These existing seating units typically provide three basic positions: a standard, nonreclined closed position; an extended position; and a reclined position. In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, these seating units require relatively complex linkage mechanisms to afford this capability. The complex linkage assemblies limit certain design aspects utilized by furniture manufacturers. In one instance, these linkage assemblies impose constraints on an upholstery designer's use of multiple styling features concurrently on an adjustable seating unit. For instance, these linkage assemblies are bulky and require seating units to incorporate space-saving features (e.g., connecting the linkage mechanisms to a base resting on the floor), thereby hiding the linkage assemblies below the seat when in the closed position. But, these space-saving features preclude a furniture designer from providing the seating unit configured with arms that rest either directly or indirectly, via the support of high legs, on an underlying surface.

In another instance, these linkage assemblies impose constraints on incorporating a single motor for automating adjustment between the positions mentioned above, and require two or more motors to accomplish automation of each adjustment. For instance, achieving a full range of motion when automatically adjusting between positions conventionally requires a plurality of large motors each with a substantial stroke. (The geometry of the linkage assembly prohibits mounting a single large motor thereto without interfering with crossbeams, the underlying surface, or moving parts attached to the linkage assembly.) As such, a more refined linkage mechanism that achieves full movement when being automatically adjusted between the closed, extended, and reclined positions would fill a void in the current field of motion-upholstery technology.

Accordingly, embodiments of the present invention pertain to a novel linkage mechanism that allows a seating unit to provide the features of a design that allows for high-leg capability and that is constructed in a simple and compact arrangement in order to provide function without impairing incorporation of desirable upholstery features. Further, embodiments of the novel linkage mechanism allow for compatibility with various styles of seating units, as well as a variety of functionality, while employing a single, standard arrangement.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Generally, embodiments of the present invention seek to provide a simplified, compact linkage mechanism that can be adapted to essentially any type of seating unit. In particular embodiments, the present invention seeks to provide a linkage mechanism that can be assembled to a compact motor and that can be adapted to essentially any type of seating unit. In operation, the compact motor in concert with the linkage mechanism can achieve full movement of the seating unit between the closed, extended, and reclined positions. The compact motor may be employed in a proficient and cost-effective manner to adjust the linkage mechanism without creating interference or other disadvantages (e.g., preclusion of adaption to high-leg models) appearing in conventional designs that are inherent with automation.

Further, beyond offering a linkage mechanism that accommodates a single motor and high-leg styling, embodiments of the present invention introduce a linkage mechanism that additionally provides compatibility with various types of seating units and functional features. For instance, in an exemplary embodiment, a right- or left-side linkage mechanism may be built as a standardized base unit that accommodates numerous types of seating units, such as high-leg and low-leg designs. By way of example, the base unit may be provided with the ability to accept one or more linkages (e.g., flipper assembly that is installed to base units that accommodate high-leg designs).

In another instance, the base unit may accommodate a set of parallel-spaced crossbeams that accommodate a motor in order to provide an automated version of the linkage mechanism. Alternatively, a bolt-on tube and manual adjustment assembly may be provided to the base unit in place of the motor. Further, the base unit may be built to hold spring(s) in the manual version, while the automated version may be configured without the springs. Thus, because the right- and left-side base units are compatible with many types of seating units and a variety of styling options, this "compatibility" of the exemplary base units helps to reduce the total number of linkage mechanisms that are fabricated and shipped to furniture manufacturers and serves to satisfy a wide array of preferences within the marketplace.

As more fully discussed below, embodiments of seating units introduced by the present invention include the following components: first and second foot-support ottomans; a seat; a backrest; a pair of arm mounting plates in substantially parallel-spaced relation; a pair of seat rails in substantially parallel-spaced relation; a seating support surface extending between the seat rails; and a pair of the generally minor-image linkage mechanisms that interconnect the arm mounting plates to the seat rails, respectively. Additionally, the seat rails support the seat via the seating support surface, which is disposed in an inclined orientation in relation to a surface underlying the seating unit. In operation, the linkage mechanisms are adapted to move between the closed position, the extended position, and the reclined position while maintaining the inclined orientation of the seat substantially throughout adjustment.

Typically, the linkage mechanisms include a pair of footrest assemblies that movably interconnect the first and second foot-support ottomans to the seat rails. Further, the footrest assemblies may include an option to attach a flipper assembly that moveably connects to a third foot-support ottoman. In operation, the footrest assemblies are adapted to extend and retract the ottomans when adjusting the seating unit between the extended and closed positions, respectively. Advantageously, during operation, the set of linkages comprising the footrest assembly are adapted to collapse to the closed position such that each member of the set of linkages and the foot-support ottomans are located below the seating support surface, yet above a lower surface of crossbeam support(s) connecting the arm mounting plates, which are raised above the underlying surface. This collapsed configuration of the footrest assembly reduces the set of linkages to a compact size such that the seating unit can incorporate high legs (e.g., legs of a traditional chair) while still hiding the linkage mechanism when adjusted to the closed position.

In addition, the linkage mechanisms each include a roller link that is translatably coupled to a respective arm mounting plate via an interaction of tracks and rollers. Specifically, in an exemplary embodiment, the arm mounting plate is configured with forward and rearward guide slots whose tracks moveably direct translation of forward and rearward rollers, respectively, which are rotatably coupled to a roller link. In turn, the roller link is pivotably coupled to the seat rail via a pair of substantially parallel-spaced TV links. Thus, during adjustment of the linkage mechanisms, the cooperative operation of the tracks, rollers, and TV links allow for translation of the seat rail over the arm mounting plate such that the closed, extended, and reclined positions are properly achieved.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
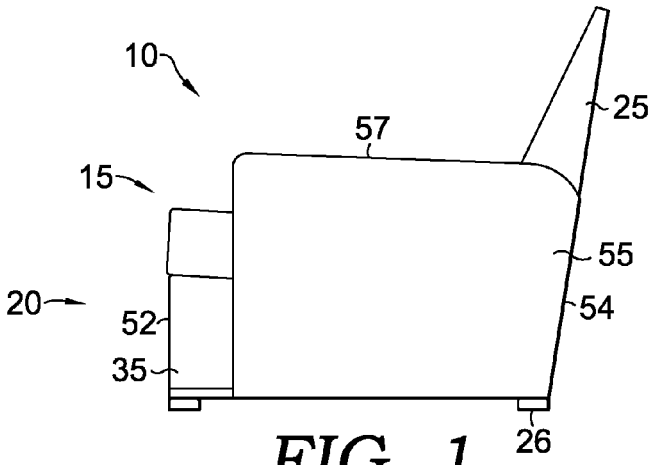
FIG. 1 is a diagrammatic lateral view of a recliner in a closed position, in accordance with an embodiment of the present invention.
Figure 2:
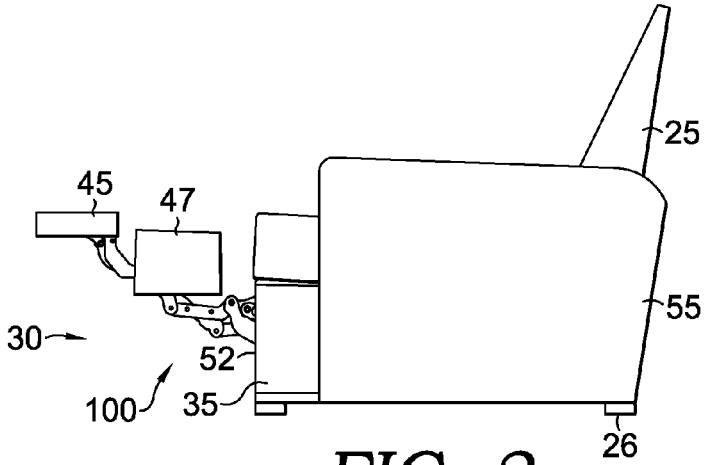
FIG. 2 is a view similar to FIG. 1, but in an extended position, in accordance with an embodiment of the present invention.
Figure 3:
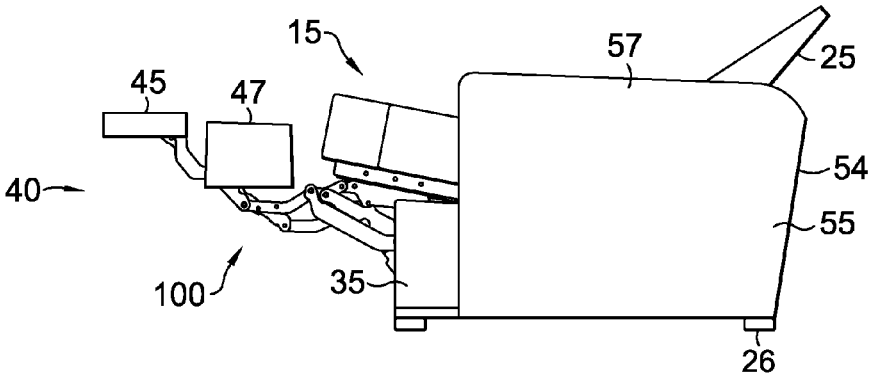
FIG. 3 is a view similar to FIG. 1, but in a reclined position with opposed arms attached to a stationary base, in accordance with an embodiment of the present invention.

FIGS. 1-3 illustrate a seating unit 10. Seating unit 10 has a seat 15, a backrest 25, legs 26, a linkage mechanism 100, a first foot-support ottoman 45, a second foot-support ottoman 47, and a pair of opposed arms 55. A third foot-support ottoman (not shown) may be provided in some embodiments and may be installed to components of a flipper assembly (discussed below) that is selectively assembled in front of the footrest assembly. Opposed arms 55 are laterally spaced and have an arm-support surface 57 that is substantially horizontal. The opposed arms 55 are supported by the legs 26, which raise it above an underlying surface (not shown).

In addition, with respect to a frame-within-a-frame style chair, the opposed arms 55 are interconnected to the seat 15 via the linkage mechanism 100 that is generally disposed between the opposed arms (i.e., substantially above a lower edge of the opposed arms). In this embodiment, the seat 15 is moveable between the opposed arms 55 during adjustment of the seating unit 10. Typically, the seat 15 is moveable according to the arrangement of the linkage mechanism 100 such that no portion of the seat 15 interferes with the opposed arms 55 throughout adjustment.

Further, with respect to a pivot-over-arm style chair, not shown in the figures, the opposed arms 55 are actually connected with the seat 15. Further, in this embodiment, the legs 26 do not support the opposed arms 55. Instead, the legs 26 support an underlying frame of the seating unit 10, such that the seat 15 is not movable between the opposed arms 55.

In one embodiment, the backrest 25 extends from a rearward section of the seating unit 10 and is rotatably coupled to the linkage mechanism 100, typically proximate to the arm-support surface 57. The first foot-support ottoman 45, the second foot-support ottoman 47, and, potentially, the third foot-support ottoman are moveably supported by the linkage mechanism 100. The linkage mechanism 100 is arranged to articulably actuate and control movement of the seat 15, the backrest 25, and the ottomans 45 and 47 between the positions shown in FIGS. 1-3, as more fully described below.

As shown in FIGS. 1-3, the seating unit 10 is adjustable to three basic positions: a closed position 20, an extended position 30 (i.e., TV position), and the reclined position 40. FIG. 1 depicts the seating unit 10 adjusted to the closed position 20, which is a normal nonreclined sitting position with the seat 15 residing in a generally horizontal position and the backrest 25 generally upright and in a substantial perpendicular biased relation to the seat 15. In a particular configuration, the seat 15 is disposed in a slightly inclined orientation relative to the arm-support surface 57. In embodiments, the inclined orientation may be maintained throughout adjustment of the seating unit 10. In addition, when adjusted to the closed position 20, the ottomans 45 and 47 and the linkage mechanism 100 are positioned below the seat 15; however, the linkage mechanism 100 does not visibly extend below the opposed arms 55.

Turning to FIG. 2, the extended position 30, or TV position, will now be described. When the seating unit 10 is adjusted to the extended position, the first foot-support ottoman 45 and the second foot-support ottoman 47 are extended forward of the opposed arms 55 and disposed generally horizontal. The backrest 25 continues to reside in a substantially perpendicular relationship to the seat 15 and does not encroach an adjacent wall. Also, the seat 15 is maintained in the inclined orientation relative to the arm-support surface 57. Thus, the configuration of the seating unit 10 in the extended position 30 provides an occupant a reclined TV position, while providing space-saving utility with respect to a rearwardly disposed wall or object. Typically, in the context of a frame-within-a-frame style chair, the seat 15 is translated slightly forward and downward relative to the opposed arms 55. However, in a pivot-over-arm style chair, the opposed arms 55 move with the seat 15. Yet, both styles mentioned above have substantially similar seat movement (i.e., forward and downward relative to the floor or legs 26 or anything else stationary). This movement of the seat 15 allows for a variety of styling to be incorporated into the seat 15, such as T-cushion styling.

FIG. 3 depicts the reclined position 40, in which the seating unit 10 is fully reclined. As discussed above, the legs 26 may extend downward from the opposed arms 55, thereby maintaining the arm-support surface 57 of the opposed arms 55 in a consistent position and orientation during adjustment of the seating unit 10. In contrast, during adjustment to the reclined position 40, the backrest 25 is rotated rearward by the linkage mechanism 100 and biased in a rearward inclination angle, while the ottomans 45 and 47 may be moved farther forward and upward from their position in the extended position 30.

The rearward inclination angle of the backrest 25, upon adjustment to the reclined position 40, is typically an obtuse angle in relation to the seat 15. However, the rearward inclination angle of the backrest 25 is typically offset by a forward and upward translation of the seat 15 as controlled by the linkage mechanism 100. This combination of movements is distinct from the operation of conventional reclining chairs that are equipped with three-position mechanisms. Specifically, conventional reclining chairs allow their backrest to rotate rearward during adjustment without providing any forward translation of the backrest, thereby requiring that the conventional reclining chairs be positioned a considerable distance from an adjacent rear wall or other proximate fixed objects. Advantageously, in embodiments of the present invention, the forward and upward translation of the seat 15 in conjunction with the rearward recline of the backrest 25 allow for zero-wall clearance. Generally, the phrase "zero-wall clearance" is utilized herein to refer to space-saving utility that permits positioning the seating unit 10 in close proximity to an adjacent rear wall and other fixed objects, while avoiding interference with the wall or the objects when adjusting into the reclined position 40.

Figure 4:
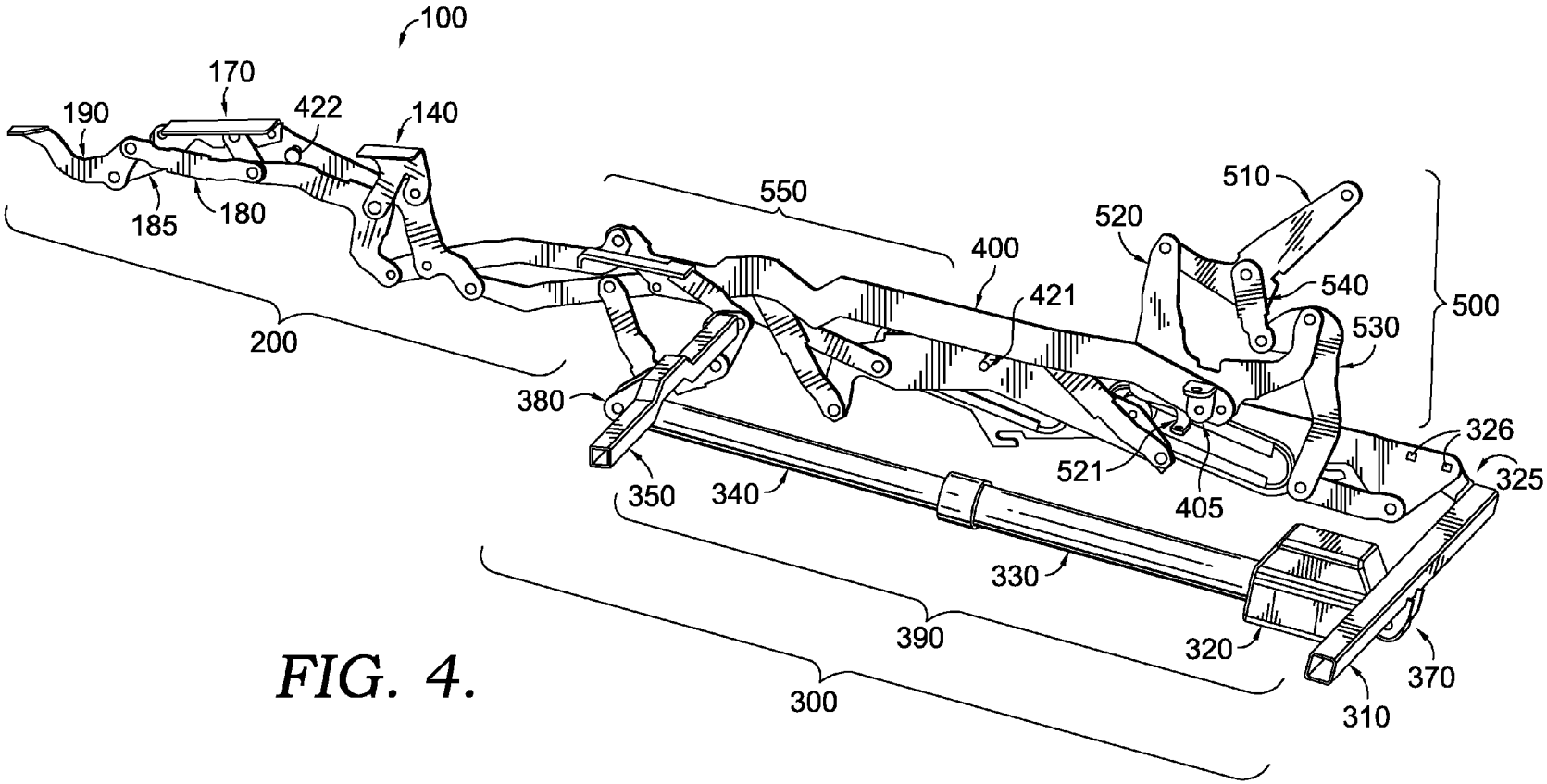
FIG. 4 is a perspective view of a linkage mechanism in the reclined position that is automated by a linear actuator, in accordance with an embodiment of the present invention.
Figure 5:
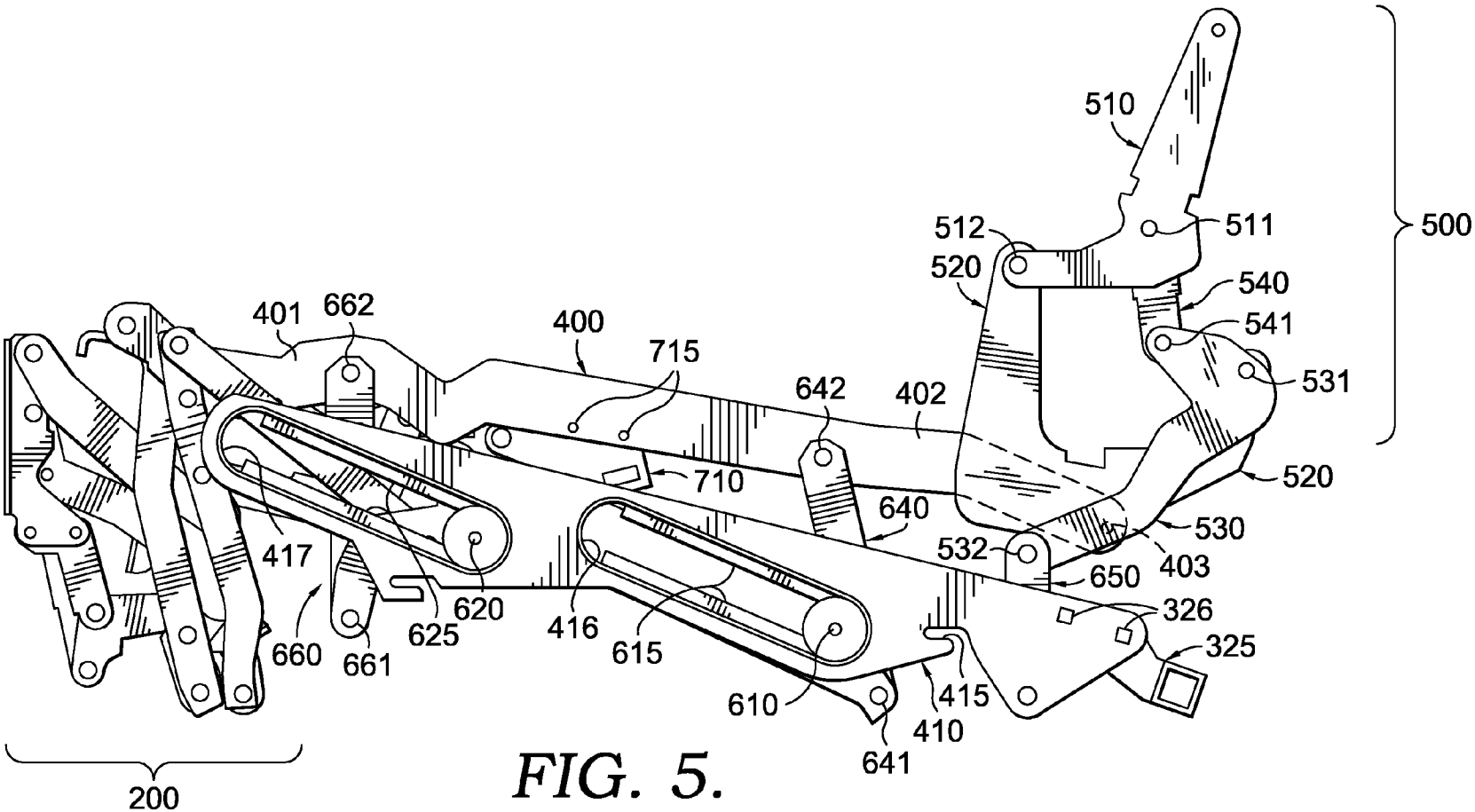
FIG. 5 is a diagrammatic lateral view of the automated linkage mechanism in the closed position from a vantage point external to the recliner, in accordance with an embodiment of the present invention.
Figure 6:
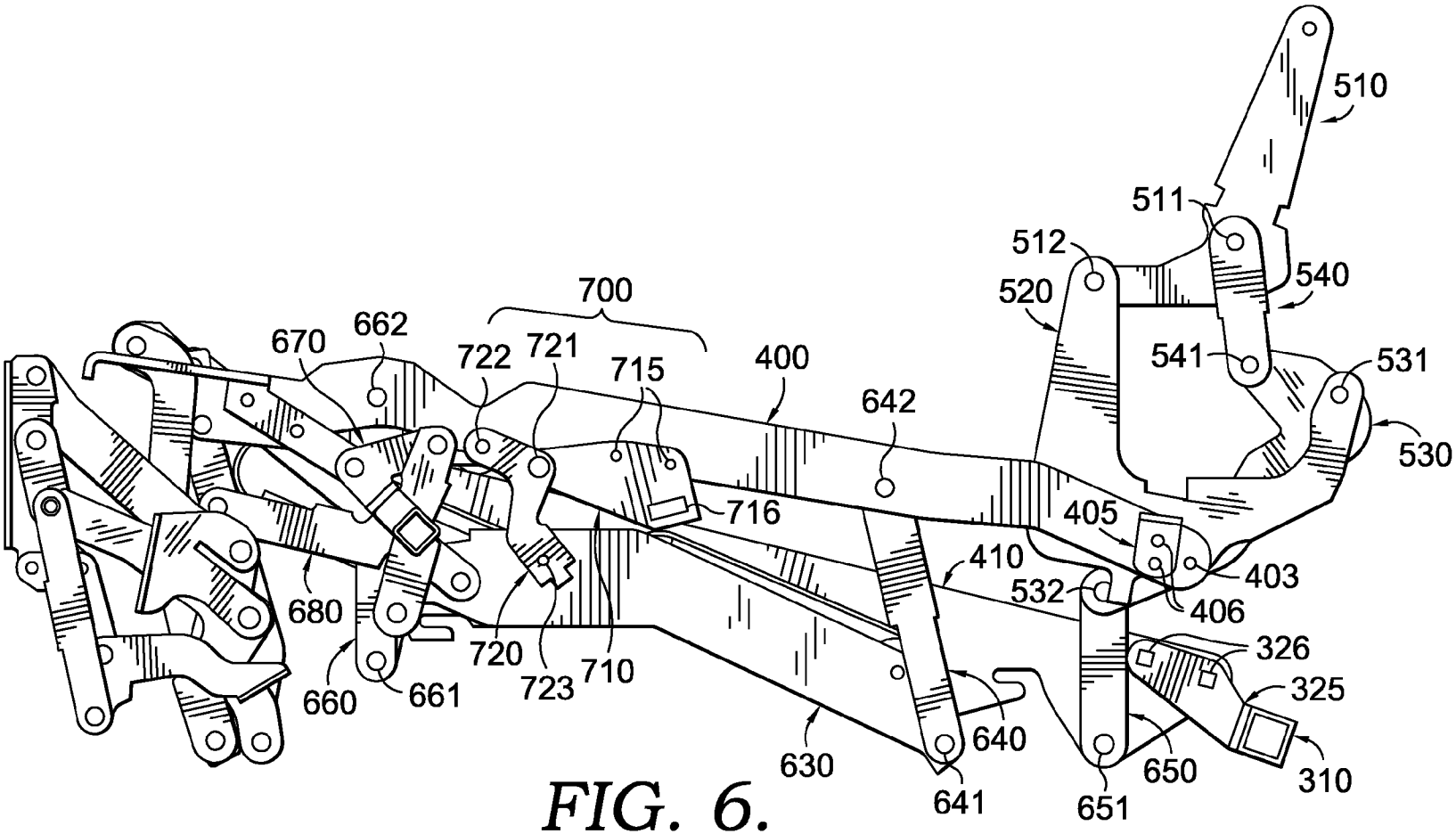
FIG. 6 is a view similar to FIG. 5, but illustrating a manually operated linkage mechanism from a vantage point internal to the recliner, in accordance with an embodiment of the present invention.

FIGS. 4-10 illustrate the configuration of the linkage mechanism 100 for a manually or automatically adjustable, zero-wall clearance, three-position recliner (hereinafter the "recliner") that is designed to assemble to a high-leg style seating unit 10. As discussed above, the linkage mechanism 100 is arranged to articulably actuate and control movement of a seat, a backrest, and ottoman(s) of the recliner between the positions shown in FIGS. 4-10. That is, the linkage mechanism 100 is adjustable to a reclined position (FIGS. 4, 9, and 10), an extended (TV) position (FIGS. 7 and 8), and a closed position (FIGS. 5 and 6).

In the reclined position, as mentioned above, the backrest is rotated rearward and biased in a rearward inclination angle, which is an obtuse angle in relation to the seat. When the recliner is adjusted to the extended position, the ottoman(s) remain extended forward, while the backrest is angularly biased substantially perpendicular to the seat. The closed position is configured as a nonreclined sitting position with the seat in a generally horizontal position and the backrest remaining generally upright. During adjustment between the closed, extended, and reclined positions, the linkage mechanism 100 employs tracks 625 and 615 that moveably couple to rollers 620 and 610, respectively, which operate in concert to translate a pair of seat rails 400 over respective arm mounting plates 410 in an inclined orientation. This translation of the seat rails 400 allows the recliner to achieve zero-wall clearance functionality, as discussed above.

Generally, the linkage mechanism 100 comprises a plurality of linkages that are arranged to actuate and control movement of the recliner during movement between the closed, the extended, and the reclined positions. Typically, in order to accomplish articulated actuation of the linkage mechanism 100, the linkages may be pivotably coupled to one or more other linkages or plates comprising the linkage mechanism 100. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are wellknown in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may be present.

In operation, the linkage mechanism 100 guides the rotational movement of the backrest, the seat, and the ottoman(s). In an exemplary configuration, these movements are controlled by a pair of essentially minor-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the recliner between the pair of opposed arms. As such, the ensuing discussion will focus on only one of the linkage mechanisms 100, with the content being equally applied to the other complimentary linkage assembly.

With particular reference to FIG. 4, a perspective view of the linkage mechanism 100 in the reclined position is shown, in accordance with an embodiment of the present invention. In embodiments, the linkage mechanism 100 includes a footrest assembly 200, the seat rail 400, the arm mounting plate 410, a seat-adjustment assembly 500, and a roller-link assembly 550. Footrest assembly 200 is comprised of a plurality of links arranged to extend and collapse the ottoman(s) during adjustment of the recliner between the extended position and the closed position, respectively. Seat rail 400 is configured to fixedly mount to the seat, and, in conjunction with an opposed seat rail, define a seat support surface (not shown).

In an exemplary embodiment, the seat rail 400 typically is a flat rail (e.g., fabricated from unformed sheet metal) without a presence of a flange or employment of angle iron. Accordingly, the seat rail 400, in conjunction with its opposed counterpart, is compatible with seat styling comprising a seat deck with webbing, which is used to lower the seat height. In embodiments, the seat deck represents a rectangular frame with longitudinal and lateral members that hold a seating surface (e.g., webbed springs) spanning therebetween in tension. Further, some manufacturers prefer to install an entire prefabricated seat deck between the linkage mechanisms, as opposed to applying tension to a seating surface after installation.

Seat-adjustment assembly 500 includes a back-mounting bracket 510 and a plurality of other links. Generally, the seat-adjustment assembly 500 is adapted to recline and incline the backrest, which is coupled to the back-mounting link 510. Roller-link assembly 550 includes the roller link 630, TV links 640 and 660, and a plurality of other links. Generally, the roller-link assembly 550 and the seat-adjustment assembly 500 are adapted to cooperate to laterally translate the seat, which is coupled to the seat rail 400. Further, the TV links 640 and 660 of the roller-link assembly 550, which are pivotably coupled between the seat rail 400 and the roller link 630, facilitate a forward shift of the seat during extension of the ottoman(s) upon extending the footrest assembly 200.

As mentioned previously, the linkage mechanism 100 may be manually actuated (e.g., using a cable-type trigger) or may be automated. This automated version of the linkage mechanism 100 will now be discussed with reference to FIG. 4. Initially, the linkage mechanism 100 may be coupled to a motor assembly 300, which provides powered adjustment of the linkage mechanism 100 between the reclined, the extended, and the closed positions. The motor assembly 300 includes a rear motor tube 310, a motor mechanism 320, a sleeve 330, a retractable piston 340, a front motor tube 350, a first motor link 370, and a second motor link 380. The motor mechanism 320 slidably drives the retractable piston 340 within the sleeve 330. This "linear actuator," is depicted by reference numeral 390 and comprised of the motor mechanism 320, the sleeve, and the retractable piston 340. Linear actuator 390 is held in position and coupled to the linkage mechanism 100 by way of the rear motor tube 310 and the front motor tube 350. Generally, the rear motor tube 310 and the front motor tube 350 span between and couple together the linkage mechanism 100 shown in FIG. 1 and its counterpart, minor-image linkage mechanism (not shown). In an exemplary embodiment, the front motor tube 350 is connected at the end to a footrest lock link 670 (see FIG. 8), which operates to rotate and open the footrest assembly 200. The rear motor tube 310 is rigidly secured on opposed ends to a pair of tube mounting brackets 325, which are bolted on to respective arm mounting plates 410. This bolt-on configuration allows for rapid conversion between manual versions, which do not include the motor tubes 310 and 350 as depicted, and automated versions of the linkage mechanism 100.

In embodiments, the motor tubes 310 and 350 function as a set of crossbeams and may be formed from square metal tubing. Alternatively, the seat rail 400, the arm mounting plate 410, the roller link 630, and the plurality of links that comprise the linkage mechanism 100 are typically formed from metal stock, such as stamped, formed steel. However, it should be understood and appreciated that any suitable rigid or sturdy material known in the furniture-manufacturing industry may be used in place of the materials described above.

As discussed above, the rear motor tube 310 is attached at opposed ends to the minor-image linkage mechanisms 100 at respective, removable tube mounting brackets 325. In addition, the rear motor tube 310 is pivotably coupled at a midsection to a housing that protects the motor mechanism 320 via the first motor link 370. The front motor tube 350 is attached at opposed ends to the minor-image linkage mechanisms 100 at a portion of the respective footrest lock link 670 proximate to pivot 671. In addition, the front motor tube 350 is pivotably coupled at a midsection to the retractable piston 340 via the second motor link 380. As illustrated in FIG. 4, the second motor link 380 provides pivotable coupling between the linear actuator 390 and the front motor tube 350, where the pivotable coupling is designed to induce the front motor tube 350 to rotate during a first phase of adjustment of the linear actuator 390 and to translate during a second phase of adjustment, as described more fully below.

In operation, the motor mechanism 320 (e.g., DC motor) causes the retractable piston 340 (e.g., motorized cylinder) to longitudinally traverse, or slide, with respect to the sleeve 330. This sliding action produces a rotational force or a lateral force, via the intervening motor links, on the front motor tube 350, which, in turn, produces movement within the linkage mechanism 100. As more fully discussed below, the sliding action of the retractable piston 340, or stroke of the linear actuator 390, is sequenced into the first phase and the second phase. In an exemplary embodiment, the first phase and second phase are mutually exclusive in stroke. In other words, the linear-actuator stroke of the first phase fully completes before the linear-actuator stroke of the second phase commences, and vice versa.

Conceptually, the retractable piston 340 may be thought of to comprise a first travel section and a second travel section. As the retractable piston 340 translates longitudinally, under automated control of the motor mechanism 320, within the first travel section (during the first phase), the longitudinal translation creates both a torque and a lateral thrust at the front motor tube 350 via the intervening second motor link 380. The torque rotatably adjusts the front motor tube 350 while the lateral thrust translates it upward and forward with respect to the rear motor tube 310. This rotation of the front motor tube 350 invokes movement of the fourth footrest link 120 via the rotation (e.g., clockwise rotation with respect to FIG. 4) of the footrest lock link 670. The movement of the fourth footrest link 120 invokes and controls adjustment of the footrest assembly 200 between the closed position and the extended position.

The upward and forward translation of the front motor tube 350 causes the seat rails 400, and likewise the seat, to shift forward during the first phase in concurrence with extending the footrest assembly 200 from the closed position to the extended position. Once a stroke of the first phase is substantially complete, the second phase occurs.

Conceptually, the second phase of adjustment of the linkage mechanism 100 involves translating the retractable piston 340 longitudinally, under automated control of the motor mechanism 320, within the second travel section thereof. Typically, the first and second travel sections abut, however, they do not overlap. It should be realized that the precise length of the travel sections, or ratio of the linear-actuator stroke allocated to each of the first phase and second phase, may vary between recliners.

Generally, the second phase involves longitudinal translation of the retractable piston 340 along the second travel section, thus, creating a lateral thrust at the front motor tube 350 via the first motor link 370. That is, the front motor tube 350 moves forward and upward with respect to the motor mechanism 320, which remains generally fixed in space. The lateral thrust translates the seat rail 400 forward and upward with respect to the arm mounting plate 410. This translation controls adjustment of the seat-adjustment assembly 500 between the extended position and the reclined position. In a particular embodiment, the translation of the seat rail 400 forward and rearward serves to recline or incline, respectively, the back-mounting link 510, and likewise the backrest. Typically, the thrust of the front motor tube 350 on the footrest lock link 670 through a lock pivot link 690 (see FIG. 8) invokes the translation of the seat rail 400.

In one instance, the electrically powered linear actuator 390, as illustrated in FIG. 4, may be controlled by a hand-operated controller that provides instructions to the linear actuator 390. These instructions may be provided upon detecting a user-initiated actuation of the hand-operated controller. Further, these instructions may cause the linear actuator 390 to carry out a complete first phase and/or second phase of movement. Or, the instructions may cause the linear actuator 390 to partially complete the first phase or the second phase of movement. As such, the linear actuator 390 may be capable of being moved to and maintained at various positions within a stroke of the first phase or the second phase, in an independent manner.

Although a particular configuration of the combination of the motor mechanism 320, the sleeve 330, and the retractable piston 340 has been described, it should be understood and appreciated that other types of suitable devices that provide sequenced adjustment may be used, and that embodiments of the present invention are not limited to the linear actuator 390 as described herein. For instance, the combination of the motor mechanism 320, the sleeve 330, and the retractable piston 340 may be embodied as a telescoping apparatus that extends and retracts in a sequenced manner.

In embodiments of the manual version, a weight of an occupant seated in the recliner and/or springs interconnecting links of the linkage mechanism 100 assist in creating the sequence. For instance, with reference to FIG. 8, spring 424 (connected between post 421 attached to the roller link 630 and formed portion 521 connected to the back pivot link 520) assists a forward shift of the seat rail 400 during adjustment to the extended position. Accordingly, the sequence ensures that adjustment of the footrest assembly 200 between the closed and extended positions is not interrupted by an adjustment of the backrest, and vice versa. In other embodiments (not shown), a sequencing assembly integrated within the linkage mechanism 100 may be provided to control the adjustment of the recliner.

With reference to FIGS. 5-10, the components of the linkage mechanism 100 will now be discussed in detail. As briefly mentioned above, the linkage mechanism 100 includes the footrest assembly 200, the seat rail 400, the arm mounting plate 410, the seat-adjustment assembly 500, and the roller-link assembly 550. Generally, one or more legs are adapted to vertically raise and support the recliner above an underlying surface. In embodiments, the leg(s) (see reference numeral 26 of FIGS. 1-3) are mounted to the arms in the frame-within-a-frame style chair, while the leg(s) are mounted to an underlying arm base (not shown) in the pivot-over-arm style chair. A hardware chassis, of which the rear motor tube 310 may be a part, is mounted to either the arm or the underlying arm base. The arm mounting plate 410 is mounted to the tube(s) (e.g., both front and rear). The seat rail 400 is interconnected to the arm mounting plate 410 via links comprising the seat-adjustment assembly 500 and the roller-link assembly 550, which translate the seat over the arm mounting plate 410 during adjustment between the closed, extended, and reclined positions while maintaining a substantially consistent angle of inclination therebetween.

Figure 7:
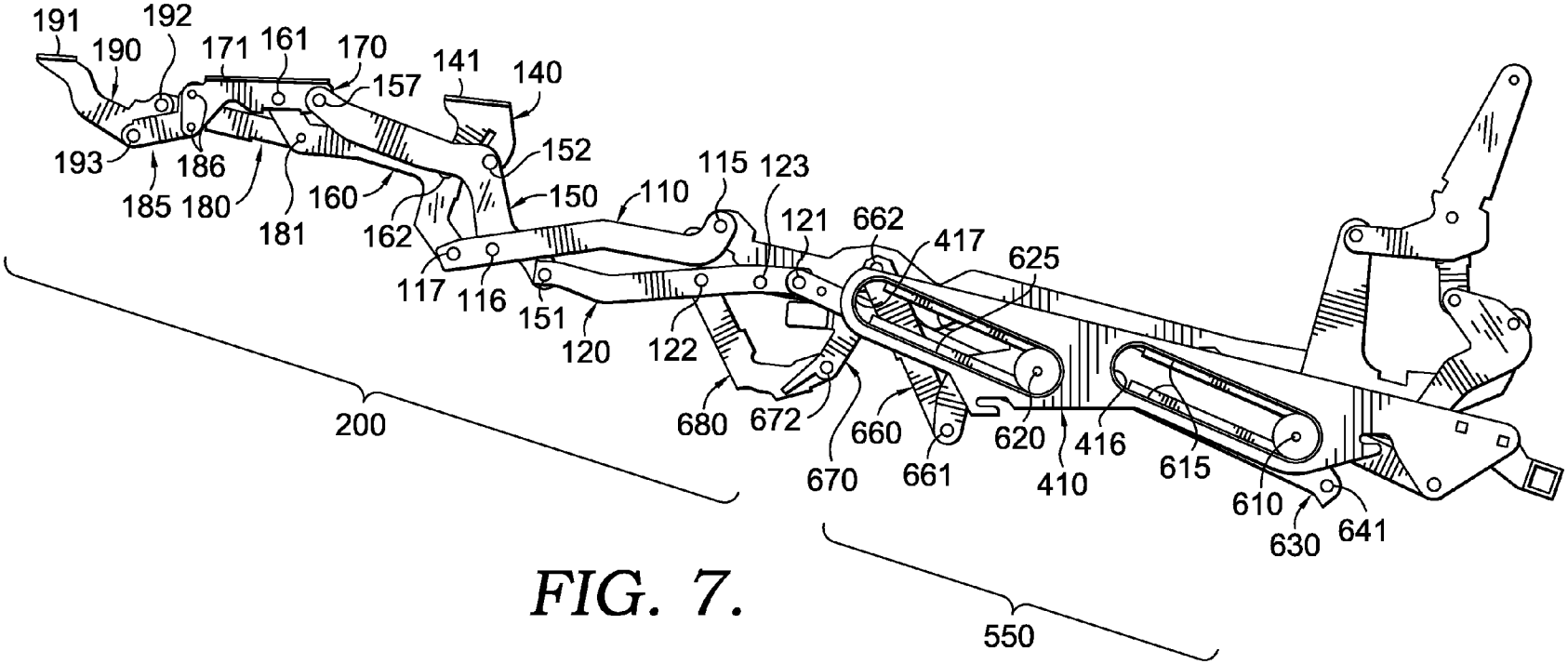
FIG. 7 is a diagrammatic lateral view of the automated linkage mechanism in the extended position from a vantage point external to the recliner, in accordance with an embodiment of the present invention.

With reference to FIG. 7, the footrest assembly 200 of a base unit of the linkage mechanism 100 will now be described. Initially, the footrest assembly 200 includes a third footrest link 110, a fourth footrest link 120, a midottoman bracket 140, a second footrest link 150, a first footrest link 160, and a front footrest bracket 170. The third footrest link 110 is rotatably coupled to a forward portion 401 of the seat rail 400 at pivot 115. The third footrest link 110 is pivotably coupled to the second footrest link 150 at pivot 116 and a lower end of the first footrest link 160 at pivot 117.

The fourth footrest link 120 is rotatably coupled to the forward portion 401 of the seat rail 400 at pivot 123 and is pivotably coupled to a lower end of the second footrest link 150 at pivot 151. In an exemplary embodiment, the pivot 123 of the fourth footrest link 120 is located rearward in relation to the pivot 115 of the third footrest link 110. Further, the fourth footrest link 120 is pivotably coupled to a front end of a TV drive link 695 (see FIG. 9) at pivot 121 and to an upper end of a footrest lock connector 680 at pivot 122. Although not shown, a rear end of the TV drive link 695 is pivotably coupled to the roller link 630 and serves to maintain a fully extended structure within the footrest assembly 200 when adjusting the linkage mechanism 100 to the reclined position.

The second footrest link 150 includes the lower end pivotably coupled to the fourth footrest link 120 at the pivot 151, a mid portion pivotably coupled to the third footrest link 110 at the pivot 116 and the midottoman bracket 140 at pivot 152, and an upper end pivotably coupled to the front footrest bracket 170 at pivot 157. Further, the second footrest link 150 includes an intermediate stop element 422 for ceasing extension for the footrest assembly 200 from the closed position to the extended position upon an edge of the first footrest link 160 making contact with the intermediate stop element 422.

With continued reference to FIG. 7, the midottoman bracket 140 includes a forward prong pivotably coupled to the first footrest link 160 at pivot 162, a rearward prong pivotably coupled to the second footrest link 150 at pivot 152, and an angled end 141 that is typically connected to the second foot-support ottoman (see reference numeral 47 of FIG. 2). The first footrest link 160 includes the lower end pivotably coupled to the third footrest link 110 at the pivot 151, a mid portion pivotably coupled to the midottoman bracket 140 at the pivot 162, and an upper end pivotably coupled to a mid portion of the front footrest bracket 170 at pivot 161, where the mid portion contacts the intermediate stop element 422 upon achieving full adjustment to the extended position.

The front footrest bracket 170 includes one end rotatably coupled to the upper end of the second footrest link 150 at the pivot 157, and the mid portion pivotably coupled to the upper end of the first footrest link 160 at the pivot 161. Typically, the front footrest bracket 170 is also configured with a formed portion 171 that is connected to the first foot-support ottoman (see reference numeral 45 of FIG. 2). In an exemplary embodiment, the first and second foot-support ottomans are disposed in generally horizontal orientations when in the extended position and the reclined position.

In an exemplary embodiment, a flipper assembly may be selectively coupled to the footrest assembly 200 in order to provide an option of a third foot-support ottoman to the base unit configuration of the linkage mechanism 100. This selective coupling may include three bolt-on points (e.g., reference numerals 186 and 181). As shown in FIG. 7, the flipper assembly includes a flipper footrest connector 180, a flipper footrest attachment link 185, and a flipper footrest bracket 190. One side of the flipper footrest connector 180 is pivotably coupled to the upper end of the first footrest link 160 at pivot 181, while the second side of the flipper footrest connector 180 is pivotably coupled to the flipper footrest bracket 190 at pivot 192. The flipper footrest attachment link 185 is fixed to the front footrest bracket 170 via attachment point 186. The flipper footrest bracket 190 is rotatably coupled to the flipper footrest attachment link 185 at pivot 193. As such, movement within the footrest assembly 200 causes rotation of the flipper footrest bracket 190 about the pivot 193 upon the flipper footrest connector 180 acting on the flipper footrest bracket 190 at the pivot 192. In this way, movement of the flipper footrest connector 180 generates extension or collapse of the third foot-support ottoman, which may be attached to a formed portion 191 of the flipper footrest bracket 190.

With reference to FIG. 6, which depicts the manual-actuation version of the linkage mechanism 100, the manual adjustment assembly 700 will now be discussed. Initially, the manual adjustment assembly 700 includes a cable-mount bracket 710 and a trigger bracket 720. The cable-mount bracket 710 is fixedly secured to the seat rail 400 at attachment points 715 and includes an aperture 716. The trigger bracket 720 is rotatably coupled to the cable-mount bracket 710 at pivot 721 and includes an extended element (e.g., rivet) 722 at an upper end and a hole 723 at a lower end. As such, the components 710 and 720 of the manual adjustment assembly 700 may be selectively and rapidly removed from the linkage mechanism 100 by removing fasteners at the attachment points 715.

In embodiments, a cable lever may be provided with the recliner when configured as the manual-actuation version. This cable lever may be attached to aperture 716 of the cable-mount bracket 710 while a flag at the end of a coaxial cable snaps into the hole 723 in the lower end of the trigger bracket 720. In operation, with reference to FIG. 6, manual actuation of the cable lever pulls the flag rearward via the coaxial cable that, in turn, rotates the trigger bracket 720 counterclockwise about the pivot 721. This counterclockwise rotation causes the extended element 722 on the upper end of the trigger bracket 720 to swing forward and contact an edge of the footrest lock connector 680, thereby pushing the footrest assembly 200 open at the pivot 122 (see FIG. 7).

Figure 8:
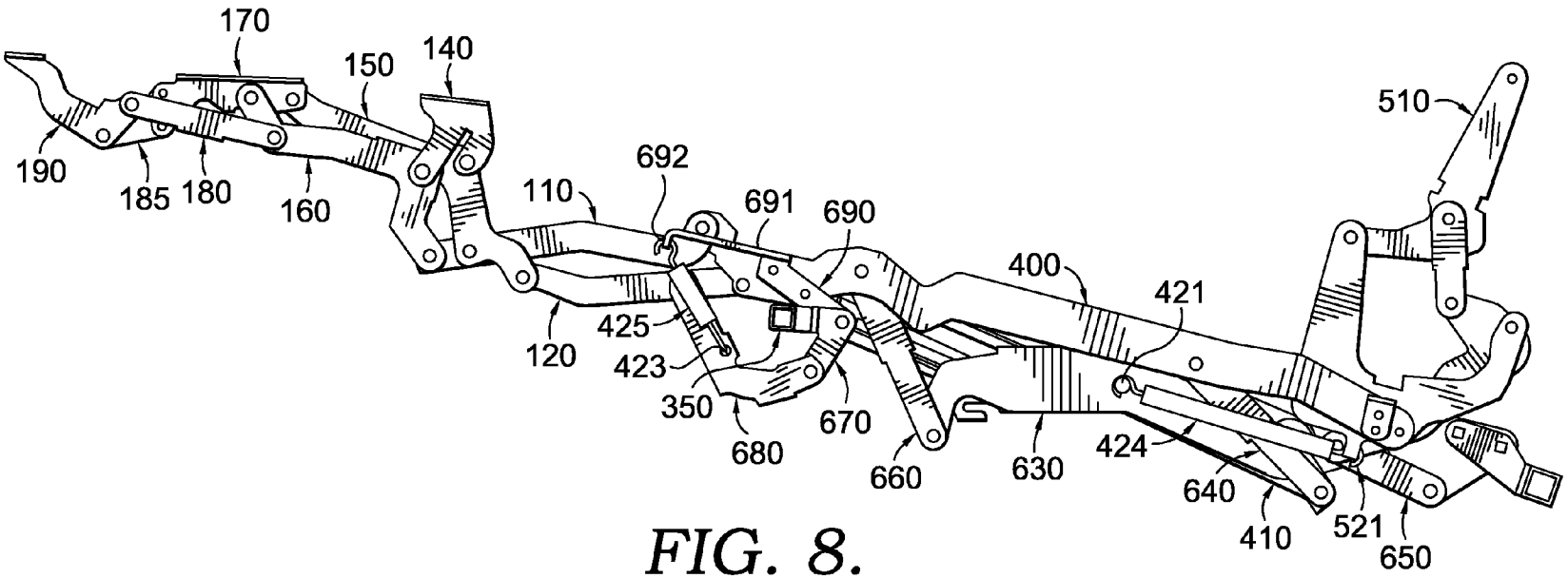
FIG. 8 is a view similar to FIG. 7, but from a vantage point internal to the recliner, in accordance with an embodiment of the present invention.

Typically, in the manual-actuation version, which does not include the linear actuator 390 and relies on a manual actuation by an occupant of the recliner to initiate adjustment, spring(s) may be provided to assist in holding the footrest assembly 200 in the closed position. As shown in FIG. 8, a lock spring 425 is provided in the manual-actuation version of the linkage mechanism 100 to ensure the footrest assembly remains collapsed until intentionally opened by the occupant. As illustrated, the lock spring 425 spans between a front end 692 of a formed portion 691 of the lock pivot link 690 and a hole 423 in a mid portion of the footrest lock connector 680. Thus, in the closed position, the lock spring 425 exerts a force that attempts to rotate the front motor tube 350 counterclockwise, thereby holding the footrest assembly 200 (including the foot-support ottomans) in the closed position. However, the arrangement of the lock spring 425 with respect to the footrest lock link 670, the footrest lock connector 680, and the lock pivot link 690 enables a slight clockwise rotation of the front motor tube 350 to push the lock spring 425 over-center. Movement of the lock spring 425 over-center (e.g., passing a longitudinal axis of the lock spring 425 over the pivot 123) causes the lock spring 425 to assist in rotating the fourth footrest link 120 clockwise about the pivot 120 on the seat rail 400, thereby forcing the footrest assembly 200 (including the foot-support ottomans) into the extended position.

Typically, conventional mechanisms had springs located in an orientation that required a large degree of rotation to arrive upon an over-center condition when adjusting from a retracted condition to a released condition of the ottomans. Thus, an occupant may be working against the springs for an extended period of time before reaching over-center. In contrast, as illustrated in FIG. 8, a relatively minimal degree of rotation of the footrest lock link 670 pushes the longitudinal axis of the lock spring 425 (directed through the formed portion 691 of the lock pivot link 690 and the hole 423 of the footrest lock connector 680) over the pivot 123, causing the occupant to reach the over-center condition with little effort.

It should be noted that the tube mounting bracket 325 and the rear motor tube 310 may be easily removed in the manual-actuation version. Further, various styles of front motor tubes 350 (e.g., straight traversing member) may be individually installed to the footrest lock link 670 via fastener-style mounting at an angled bracket thereon. Even further, the lock spring 425 may be easily installed or removed from its connection points without additional modification to the linkage mechanism 100. As such, the linkage mechanism may be quickly converted between the manually actuated version and an automated version (employing the linear actuator 390) using standard tools and without significant modification to the base unit.

Figure 9:
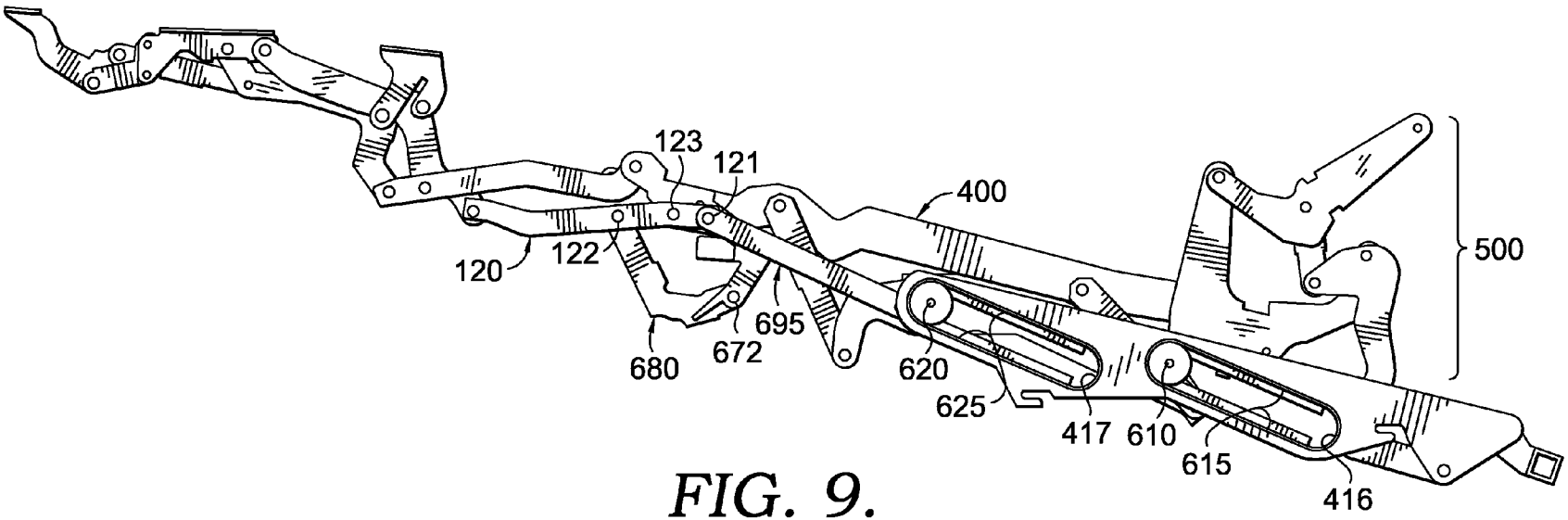
FIG. 9 is a diagrammatic lateral view of the automated linkage mechanism in the reclined position from a vantage point external to the recliner, in accordance with an embodiment of the present invention.
Figure 10:
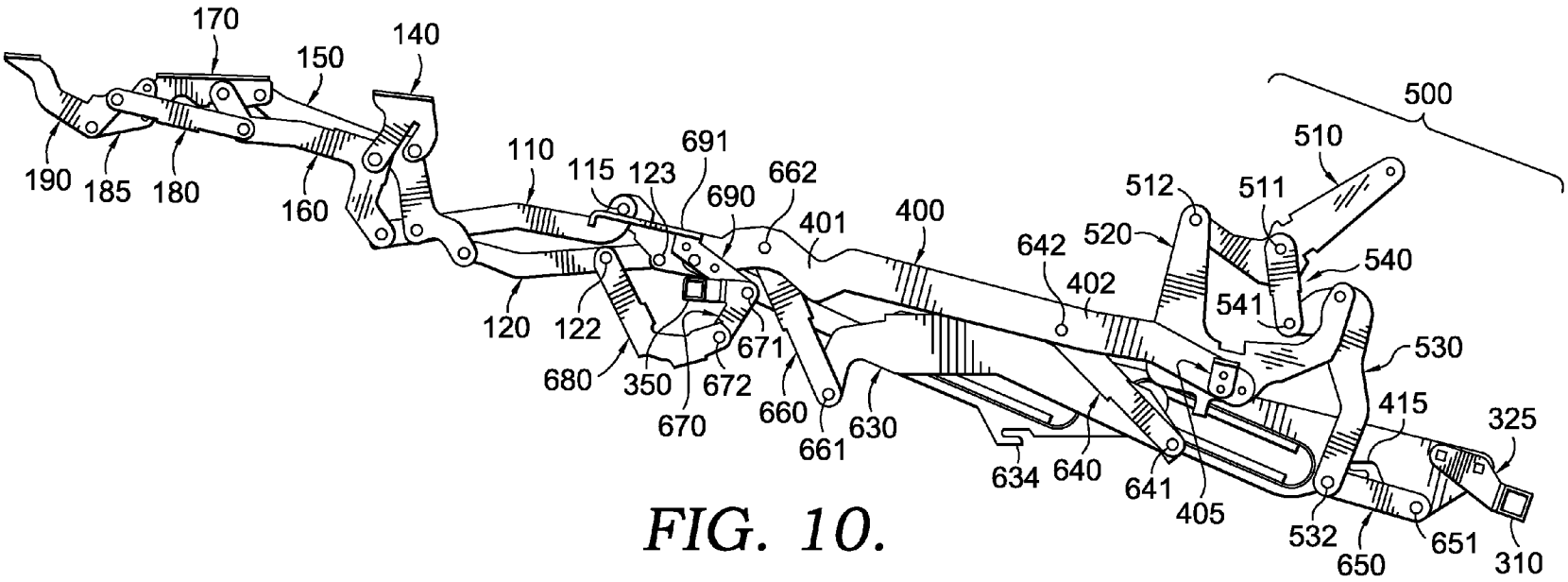
FIG. 10 is a view similar to FIG. 9, but from a vantage point internal to the recliner, in accordance with an embodiment of the present invention.

With continued reference to FIGS. 5-10, the seat-adjustment assembly 500 will now be discussed in accordance with an embodiment of the present invention. Generally, the seat-adjustment assembly 500, in cooperation with the roller-link assembly 550, provides for straight-line translation of the seat rail 400 over the arm mounting plate 410 during movement in the second phase (adjusting between the extended and reclined positions). With reference to FIG. 10, the seat-adjustment assembly 500 includes the back-mounting link 510, a back pivot link 520, a recline drive link 530, a back connector link 540 and a recline pivot link 650. The back-mounting link 510 is rotatably coupled to the back connector link 540 at pivot 511 and is pivotably coupled to the back pivot link 520 at pivot 512.

The back pivot link 520 is attached to the seat rail 400 (see attachment point 403 on FIG. 5) and includes a forward prong and a rearward prong. The forward prong is pivotably coupled to the back-mounting link 510 at the pivot 512, while the rearward prong is pivotably coupled to the recline drive link 530 at pivot 531 (see FIG. 5). The recline drive link 530 is rotatably coupled at a mid portion to the back pivot link 520 at the pivot 531. Further, the recline drive link 530 is pivotably coupled at an upper end to the back connector link 540 at pivot 541 and at a lower end to the recline pivot link 650 at pivot 532. The back connector link 540 is pivotably coupled at an upper end to the back-mounting link 510 at the pivot 511 and at a lower end to the recline drive link 530 at the pivot 541. The recline pivot link 650 is pivotably coupled at a front end to the recline drive link 530 at the pivot 532 and at a back end to the arm mounting plate 410 at pivot 651.

Embodiments of the roller-link assembly 550 of FIG. 4 will now be discussed. Turning to FIG. 7, showing the linkage mechanism 100 in the extended position with the seat rail 400 shifted rearward, and to FIG. 9, showing the linkage mechanism 100 in the reclined position with the seat rail 400 shifted forward, an illustrative roller-link assembly 550 includes the roller link 630 (having the rollers 610 and 620 installed thereto), a rearward TV link 640, a forward TV link 660, the footrest lock link 670, the footrest lock connector 680, the lock pivot link 690, and the TV drive link 695 (discussed above in the context of the footrest assembly 200).

Initially, the arm mounting plate 410 includes a forward guide slot 417 and a rearward guide slot 416 that have tracks 625 and 615, respectively, installed thereto. In embodiments, the roller link 630 includes the forward roller 620 and the rearward roller 610 that are rotatably coupled thereto. In operation, the forward and rearward rollers 620 and 610 are moveably engaged to the tracks 625 and 615, respectively, of the forward and rearward guide slots 417 and 416. In this way, the tracks 625 and 615 act to capture and control movement of the forward and rearward rollers 620 and 610, respectively. This engagement between the tracks 625 and 615 and the rollers 620 and 610, respectively, allows the seat rail 400 to translate forward and upward, per the orientation of the guide slots 416 and 417, when adjusting from the extended to the reclined position. In an exemplary embodiment, the rollers 620 and 610 move from a lower-rearward area of the tracks 625 and 615, respectively, to an upper-forward area of the tracks 625 and 615, respectively, when moving from the extended position to the reclined position. Accordingly, the rearward roller 610 supports the occupant in the rearward portion 402 of the seat rail 400, while the forward roller 620 carries the forward portion 401 of the seat rail 400. Further, in comparison with conventional mechanisms, the linkage mechanism 100 of the embodiments of the present invention is able to eliminate various links and reduce cost by adding the forward roller 620. Even further, the forward roller 620 improves balance on full recline movement and increases recline layout.

It should be understood and appreciated that tracks 625 and 615 and the rollers 620 and 610 may be made out of any material known in the relevant field (e.g., metal, hard-durometer rubber, or plastic) and the rollers 620 and 610 may be rotatably coupled to the roller link 630 by any mechanism known in the relevant field (e.g., pin with lubricated shaft, rivet, or ball bearings). Further, although the engagement of the tracks 625 and 615 and the rollers 620 and 610, respectively, is employed to achieve translation of the seat rail 400 over the arm mounting link 410, it should be appreciated and understood that other types of mechanism to angularly shift one link with respect to another link may be used in place of components of the roller mechanism 550. For instance, slots within the arm mounting link 410 that guide pins extending from the roller link 630 through the slots, respectively, may be used instead of rollers and tracks.

The forward TV link 660 includes an upper end and a lower end. The upper end of the forward TV link 660 is pivotably coupled to the forward portion 401 of the seat rail 400 at pivot 662, while the lower end of the forward TV link 660 is pivotably coupled to a forward portion of the roller link 630 at pivot 661. The rearward TV link 640 includes an upper end and a lower end. The upper end of the rearward TV link 640 is pivotably coupled to the rearward portion 402 of the seat rail 400 at pivot 642, while the lower end of the rearward TV link 640 is pivotably coupled to a back portion of the roller link 630 at pivot 641. During movement between the extended and reclined positions, the forward TV link 660 and the rearward TV link 640 are designed to "swing," or angularly bias, in substantially parallel-spaced relation to one another. For instance, the forward TV link 660 and the rearward TV link 640 both swing a first angular increment when adjusting from the closed position (FIG. 6) to the extended position (FIG. 8). Also, the forward TV link 660 and the rearward TV link 640 both swing a second angular increment when adjusting from the extended position (FIG. 8) to the reclined position (FIG. 10).

The footrest lock link 670 is pivotably coupled to the lock pivot link 690 at the pivot 671, where the lock pivot link 690 is attached to the forward portion 401 of the seat rail 400, as best shown in FIG. 10. The footrest lock link 670 is also pivotably coupled to the footrest lock connector 680 at the pivot 672. Further, the footrest lock link 670 is attached to the front motor tube 350 via fasteners and/or an angled bracket. The footrest lock connector 680 is pivotably coupled to the footrest lock link 670 at the pivot 671 and to the fourth footrest link 120 at the pivot 122.

In operation, the footrest lock link 670, the footrest lock connector 680, the lock pivot link 690, and the TV drive link 695 act in concert to de-collapse and hold in the extended position the footrest assembly 200 via either manual or automated actuation. In a specific embodiment of de-collapsing the footrest assembly 200, movement from the closed position of FIGS. 5 and 6 to the extended position of FIGS. 7 and 8 may be accomplished. Initially, a clockwise rotation of the footrest lock link 670 about the pivot 671 triggers the footrest assembly 200 to de-collapse. The rotation of the footrest lock link 670 may be caused by a rotation of the front motor tube 350 (using the linear actuator of the automated version) or by the extended element 722 on the upper end of the trigger bracket 720 swinging forward and contacting an edge of the footrest lock connector 680, which is pivotably coupled to the footrest lock link 670. As the footrest lock link 670 moves in a clockwise direction, the movement of the pivot 672 pushes the footrest lock connector 680 that, in turn, applies a forward and upward force to the pivot 122 on the fourth footrest link 120. This forward and upward force rotates the fourth footrest link 120 forward about the pivot 123, thereby causing a remainder of the links comprising the footrest assembly 200 to de-collapse.

It should be understood that the construction of the linkage mechanism 100 lends itself to enable the various links and brackets to be easily assembled and disassembled from the remaining components of the recliner. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit having a seat, a backrest, and at least one foot-support ottoman, the seating unit being adapted to move between a closed, an extended, and a reclined position, the seating unit comprising:

a pair of arm mounting plates in substantially parallel-spaced relation, wherein each of the arm mounting plates includes a forward guide slot and a rearward guide slot having respective tracks installed thereto;

a pair of seat rails in substantially parallel-spaced relation, wherein the seat rails translatably carry the seat over the arm mounting plates; and a pair of the generally mirror-image linkage mechanisms each moveably interconnecting each of the arm mounting plates to a respective seat rail, wherein each of the linkage mechanisms comprise:

(a) a roller link that includes a forward roller and a rearward roller that are rotatably coupled thereto, wherein the forward and rearward rollers are translatably engaged to the tracks of the forward and rearward guide slots, respectively;

(b) a forward TV link that includes an upper end and a lower end, wherein the upper end of the forward TV link is pivotably coupled to a forward portion of the seat rail and the lower end of the forward TV link is pivotably coupled to a forward portion of the roller link;

(c) a rearward TV link that includes an upper end and a lower end, wherein the upper end of the rearward TV link is pivotably coupled to a rearward portion of the seat rail and the lower end of the rearward TV link is pivotably coupled to a rearward portion of the roller link;

(d) a lock pivot link that is fixedly and non-rotatably attached to the forward portion of the seat rail; and (e) a footrest lock link that is pivotably coupled to the lock pivot link and is operatively coupled to a front drive tube, which rotates to pivot the footrest lock link.

2. The seating unit of claim 1, wherein the arm mounting plates are mounted to one or more legs that are adapted to vertically raise and support the arm mounting plates above an underlying surface.

3. The seating unit of claim 1, wherein the translatable engagement of the forward and rearward rollers to the tracks is configured to allow the seat to shift forward during extension of the at least one foot-support ottoman.

4. The seating unit of claim 1, wherein the forward TV link and the rearward TV link are configured to pivot in a substantial parallel-spaced relation.

5. The seating unit of claim 1, wherein the lock pivot link includes a member extending therefrom, and wherein the footrest lock link that is pivotably coupled to the lock pivot link includes a hole formed therein.

6. The seating unit of claim 5, wherein the linkage mechanism further comprises a spring that spans between the hole in the footrest lock link and the member extending from the lock pivot link, wherein the spring is configured to resist the at least one foot-support ottoman when adjusted to the closed position and to promote extension of the at least one foot-support ottoman when adjusted to the extended position.

7. The seating unit of claim 6, further comprising:

a rear drive tube that, at one end, is selectively attached to a respective arm mounting plate via a bolt-on connection; and a linear actuator that is pivotably coupled to the front drive tube and to the rear drive tube at opposed ends of the linear actuator.

8. The seating unit of claim 7, wherein the linear actuator is configured to extend and contract, thereby moving the seating unit between the closed, the extended, and the reclined position.

9. The seating unit of claim 8, wherein extension of the linear actuator is separated into a first phase and a second phase, wherein the first phase rotates the footrest lock link causing the at least one foot-support ottoman to extend, and wherein the second phase translates the seat rail forward with respect to the arm mounting plate.

10. A linkage mechanism that moveably interconnects an arm mounting plate, which is vertically raised above an underlying surface by at least one leg, to a seat rail, which is adapted to translate a seat with respect to the arm mounting plate, wherein the linkage mechanism comprises:

a forward track installed within a forward guide slot of the arm mounting plate;

a rearward track installed within a rearward guide slot of the arm mounting plate;

a roller link;

a forward roller rotatably coupled to the roller link, wherein the forward roller is translatably engaged to the forward track;

a rearward roller rotatably coupled to the roller link, wherein the rearward roller is translatably engaged to the rearward track; and a lock pivot link fixedly and non-rotatably attached to a forward portion of the seat rail, wherein a footrest lock link is pivotably coupled to the lock pivot link and is attachable to a front drive tube.

11. The linkage mechanism of claim 10, further comprising a forward TV link that includes an upper end and a lower end, wherein the upper end of the forward TV link is pivotably coupled to a forward portion of the seat rail and the lower end of the forward TV link is pivotably coupled to a forward portion of the roller link.

12. The linkage mechanism of claim 10, further comprising a rearward TV link that includes an upper end and a lower end, wherein the upper end of the rearward TV link is pivotably coupled to a rearward portion of the seat rail and the lower end of the rearward TV link is pivotably coupled to a rearward portion of the roller link.

13. The linkage mechanism of claim 10, wherein the forward track and the rearward track operate in concert to translate the seat rail over the arm mounting plate in a substantially consistent inclined orientation during translation.

14. The linkage mechanism of claim 10, wherein the seat rail is fixedly mounted to the seat, and, in conjunction with an opposed seat rail, define a seat support surface.

15. The linkage mechanism of claim 14, wherein the seat rail is configured as a substantially flat rail and the seat is configured as a rectangular frame with a material held in tension, and wherein the seat is configured to span the seat support surface.

16. A linkage mechanism that is configured to adjust a seating unit between a closed, an extended, and a reclined position, wherein the linkage mechanism comprises:

an arm mounting plate that has a forward guide slot and a rearward guide slot formed therein;

a seat rail configured to translatably carry an occupant of the seating unit with respect to the arm mounting plate;

a roller link assembly for translatably coupling the seating unit to the arm mounting plate, wherein the roller link assembly comprises:

(a) a forward track installed within a forward guide slot of the arm mounting plate;

(b) a rearward track installed within a rearward guide slot of the arm mounting plate;

(c) a roller link;

(d) a forward roller rotatably coupled to the roller link, wherein the forward roller is translatably engaged to the forward track;

(e) a rearward roller rotatably coupled to the roller link, wherein the rearward roller is translatably engaged to the rearward track;

(f) a lock pivot link that is fixedly and non-rotatably attached to a forward portion of the seat rail; and (g) a footrest lock link that is pivotably coupled to the lock pivot link and is operatively coupled to a front drive tube, which rotates to pivot the footrest lock link.

17. The linkage mechanism of claim 16, wherein the roller-link assembly further comprises a forward TV link that includes an upper end and a lower end, wherein the upper end of the forward TV link is pivotably coupled to a forward portion of the seat rail and the lower end of the forward TV link is pivotably coupled to a forward portion of the roller link.

18. The linkage mechanism of claim 16, wherein the roller-link assembly further comprises a rearward TV link that includes an upper end and a lower end, wherein the upper end of the rearward TV link is pivotably coupled to a rearward portion of the seat rail and the lower end of the rearward TV link is pivotably coupled to a rearward portion of the roller link.

19. The linkage mechanism of claim 16, wherein the roller-link assembly further comprises:

a footrest lock connector having a first end and a second end, wherein the first end of the footrest lock connector is pivotably coupled to the footrest lock link and the second end of the footrest lock connector is pivotably coupled to a footrest link of a footrest assembly for extending and retracting one or more foot-support ottomans; and a TV drive link having a front end and a rear end, wherein the front end of the TV drive link is pivotably coupled to the footrest link of the footrest assembly and the rear end is pivotably coupled to the roller link, and wherein the footrest link is rotatably coupled to the seat rail.

* * * * *